United States Patent [19]

Irwin, Sr. et al.

[11] 4,010,028

[45] Mar. 1, 1977

[54] BONDED CALCIUM CARBIDE ARTICLE AND METHOD FOR MAKING THE SAME

[75] Inventors: Donald A. Irwin, Sr., Naugatuck; Gordon H. Madge, Watertown; Charles F. Kloss, Waterbury; Allen L. Stone, Cheshire, all of Conn.

[73] Assignee: Uniroyal Inc., New York, N.Y.

[22] Filed: July 29, 1974

[21] Appl. No.: 492,801

[52] U.S. Cl. ..... 75/53; 75/58

[51] Int. Cl.[2] ..... C21C 7/02

[58] Field of Search ..... 75/53, 58

[56] References Cited

UNITED STATES PATENTS

| | | | |
|---|---|---|---|
| 3,158,913 | 12/1964 | Bolkcom | 75/58 |
| 3,551,139 | 12/1970 | Shokkenbroek | 75/53 |
| 3,768,999 | 10/1973 | Ohkubo | 75/53 |

*Primary Examiner*—Peter D. Rosenberg
*Attorney, Agent, or Firm*—Willard R. Sprowls

[57] ABSTRACT

A bonded calcium carbide article that is solid and self-supporting is obtained by mixing granular calcium carbide with a suitable bonding agent. The resultant bonded calcium carbide article, which is easy and safe to handle, can be effectively and efficiently used as a sulfur scavenger in the refining of metals and metal alloys.

22 Claims, 2 Drawing Figures

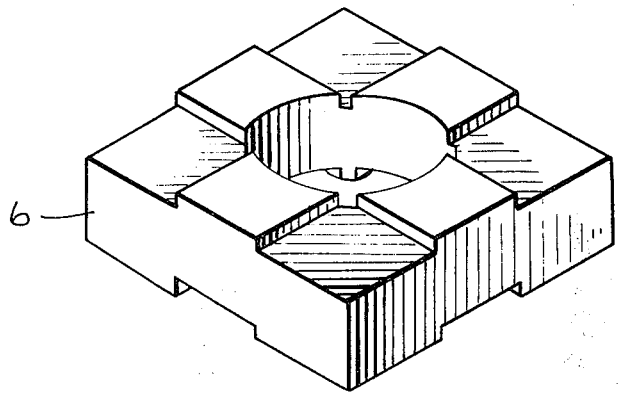
Fig. 1.
Fig. 2.
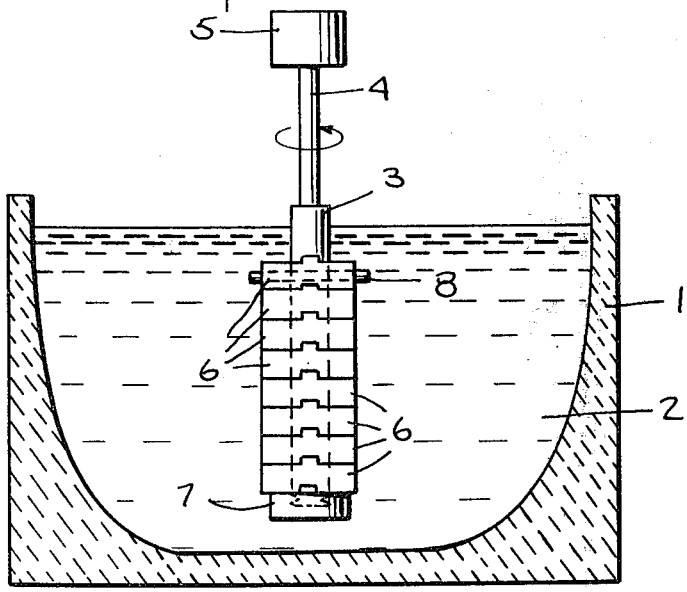

BONDED CALCIUM CARBIDE ARTICLE AND METHOD FOR MAKING THE SAME

This invention relates to a molded, granular carbide article for use in the refining of metals and metal alloys.

BACKGROUND OF THE INVENTION

Calcium carbide is used as a sulfur scavenger in the refining of metals and metal alloys, particularly in the refining of iron because too high a sulfur content results in brittle steel. Presently, calcium carbide is introduced into the molten metal or metal alloy in granular or powdered form by, in some instances, literally shoveling the loose granules into the molten mass. This method has not been found to be satisfactory, as the exposed granules lose their effectiveness in the open atmosphere, especially at high humidity. Exposure of the calcium carbide granules to humidity results in the production of lime and acetylene, thereby rendering the calcium carbide useless for its intended purpose.

Another problem encountered is that of obtaining the desired dispersion of the relatively low density granular material in the relatively high density molten metals. Thus, when granular calcium carbide is introduced into molten metals in loose form, the granules tend to float on the surface of the molten metal, resulting in only localized concentration of the granules thereby rendering the granular calcium carbide inefficient or ineffective.

One attempt to overcome this problem of proper dispersion has been by packing the granular calcium carbide in steel drums and then maintaining the drums submerged in the molten mass which is usually at a temperature in excess of 1370° C. When the steel drums melt, the granules are released into the molten mass. However, the steel drums melt quickly and suddenly release the granules, which, rather than being dispersed in the molten metal, tend to rapidly rise to the surface where they become mixed with the slag and therefore are only partially able to scavenge sulfur.

Another attempt to overcome this dispersion problem has been by blowing the granular or powdered calcium carbide into the lower levels of the molten mass by means of compressed gas. However, this technique is also not satisfactory due to the buoyancy effect of the granules and the tendency of the granules to clog the inlets through which they are blown into the molten mass necessitating frequent clearing of these inlets.

Although it is only remotely related to the invention described herein, it should be pointed out that it is known to mold non-metallic powders such as those used in ceramics into a solid mass by combining the non-metallic powder with an organic, heat fugitive agent such as a polymer resin that is depolymerizable or decomposable upon being subjected to heat. Upon heating, the polymer resin vaporizes out of the non-metallic material to obtain a vitrified article of desired shape comprising the non-metallic powder as disclosed in U.S. Pat. No. 2,593,507.

It would be desirable, therefore, to provide a means whereby granular or powdered calcium carbide or other suitable sulfur scavengers, could be introduced into molten metals in a manner that would enable the calcium carbide to be properly dispersed so that it could effectively and efficiently perform its intended function. It would also be desirable to provide granular or powdered calcium carbide in a form that would greatly reduce, if not eliminate, the effects of high humidity atmospheres on said granules.

THE INVENTION

These desirable ends have now been attained by this invention. Accordingly, it has been found that granular or powdered calcium carbide can now be bonded into a solid, self-sustaining mass of any desired configuration, such as blocks, so that the calcium carbide granules are protected from exposure to moisture and are capable of being submersed in molten metals, resulting in controlled and adequate dispersion of the granules, thereby enabling the calcium carbide to effectively and efficiently scavenge the sulfur impurities contained in the molten metals.

In general, bonding of granular or powdered calcium carbide into a solid, self-sustaining mass is accomplished by intimately mixing the granular or powdered calcium carbide with a suitable bonding agent or adhesive, transferring the mix to a mold, and forming the mix in the mold to obtain a solid, self-sustaining article. The bonded calcium carbide articles should have enough structural integrity to permit immersion in a molten metal and should preferably be able to withstand rotational and buoyancy forces encountered in use. The article should also be capable of withstanding the high temperatures for a period of time sufficient to cause the article to erode at a controlled rate and thereby release the granules so that they become adequately dispersed in the molten metal and are capable of performing their function as a sulfur scavenger.

The foregoing and other objects, characteristics and advantages of the present invention will be more clearly understood from the following detailed description when read in conjunction with the accompanying drawings, in which:

FIG. 1 is a perspective illustration of a calcium carbide granule block according to the present invention; and FIG. 2 is a generally schematic vertical section through a liquid steel bath having an assembly of the blocks of FIG. 1 immersed therein.

Referring now to the drawings in greater detail, FIG. 1 provides an elevated diagonal view of a block 6 as used in Example III. The block is essentially of a truncated cube shape, traversed by a circular bore, perpendicular to and in the center of said block. The top surface of the block comprises raised face portions arranged in a cross-wise fashion. The bottom surface contains recesses of such a configuration and size that allow insertion of the raised face portions of a subsequent block. The said bore provides means for securing blocks around a supporting shaft.

FIG. 2 is a cross-sectional side view of a bonded calcium carbide block assembly immersed in molten steel, wherein 1 represents a crucible containing molten steel 2 in which is immersed a graphite shaft 3, the latter being firmly attached at its upper end to rotational driving means comprising a shaft 4 and a motor 5. Around the graphite shaft is attached an assembly of eight stacked, bonded calcium carbide interlocking blocks 6, secured on the bottom by a threaded graphite block retaining cap 7 which is firmly but removably attached to the lower end of the graphite shaft. A graphite peg 8 inserted through a bore located perpendicular to the axis of said assembly and penetrating the uppermost block and the graphite shaft provides means for maintaining the assembly in place when it is immersed in said molten steel.

In accordance with the invention, the granule or powder size of the calcium carbide is not critical to the method of bonding and calcium carbide having a size up to what is known to the art as Miner's lamp is suitable. Calcium carbide granules having the size of Rice or smaller have been found to be adequate for handling, and for obtaining a good admixture with and cohesion to a suitable bonding agent to produce a bonded calcium carbide article. For safe handling of calcium carbide, one should consult with the "Chemical Safety Data Sheet SD-23" published by the Manufacturing Chemists Association (1967) as well as the bulletin by Occupational Safety and Health Administration, Vol. 36, No. 105, Part II, Section 1910.252.

Bonding agents comprising polymers crosslinked in the presence of the calcium carbide are preferred over non-crosslinked polymeric binders because they are able to maintain their structural configuration more readily under the extreme conditions encountered. Under the first category fall polymers such as those based on polyurethane prepolymer and one-shot systems, polyesters, phenolic and epoxy resins as well as curable liquid rubbers such as derived from styrene-butadiene copolymers, ethylene-propylene-non-conjugated diene terpolymers, polybutadiene, isobutylene-diene copolymers and polysulfide polymers.

Under the non-crosslinked systems, i.e., those polymers which are not further treated to form a three dimensional network, fall the above mentioned polymers with the exception of the liquid rubbers, and includes also polymers such as poly(vinyl chloride), poly(acrylonitrile-styrene), certain polyamides, polyacrylates, and the like. If desirable, the blend of calcium carbide and polymer may be achieved by applying the polymers as a melt, provided the softening and/or mixing temperature does not lead to decomposition of the polymer, or these polymers may be employed as a solution in a suitable solvent necessitating removal of the solvent during or after mixing the ingredients.

The preferred bonding agents are the aforementioned urethane-based polymers which can be used either in the prepolymer form with the curatives, i.e., curing or cross-linking agent, added, or in the form of a one-shot system.

Typical of the polyurethane prepolymers that can be used are such as are obtained as the reaction products of hydroxy-terminated polyethers, usually diols (and/or higher polyols such as triols), preferably polyalkylene ether glycols (suitably those having a molecular weight of about 500 or less to 6,000 or more), such as polyethylene ether glycol, polypropylene ether glycol, polytetramethylene ether glycol, and the like, with at least an approximately equivalent amount of an aromatic, aliphatic or cycloaliphatic diisocyanate. Suitable polyisocyanates include the toluene diisocyanates (TDI) such as 2,4-toluene diisocyanate, 2,6-toluene diisocyanate and mixtures of the two isomers. Crude mixtures which are commercially available are also useful. Other suitable polyisocyanates are methylenebis(4-phenyl isocyanate) (MDI), methylenebis(4-cyclohexyl isocyanate), hexamethylene diisocyanate, 1,5-naphthalene diisocyanate, 1,3-cyclopentylene diisocyanate, dimer acid diisocyanate, p-phenylene diisocyanate, as well as crude and polymeric commercial mixtures of such polyisocyanates. Suitable polyethers and aromatic diisocyanates, as well as the prepolymers obtained therefrom, are disclosed in such U.S. Pat. Nos. as 2,957,852; 3,257,261; 3,284,539; and 3,351,608, as well as the references cited therein.

The polyester-type polyols are well known in the art and require no detailed description here. It will be understood that they include chain extended polyesters made from a glycol (e.g., ethylene and/or propylene glycol) and a saturated dicarboxylic acid (e.g., adipic acid). By way of non-limiting examples, there may be mentioned poly(ethylene adipate) glycol, poly(propylene adipate) glycol, poly(butylene adipate) glycol, poly(caprolactone) glycol, poly(ethylene adipatephthalate) glycol and poly(neopentyl sebacate) glycol. Tri-alcohols such as trimethylolpropane or trimethylolethane may be included in the polyester preparation. Polyester polyols with functionalities of three or more (e.g., glycerides of 12-hydroxystearic acid) are also useful. Suitable polyester polyols include those obtainable by reacting any of the compounds mentioned hereinbelow under chain extenders with such dicarboxylic acids as adipic acid, succinic acid, glutaric acid, azelaic acid, sebacic acid, malonic acid, maleic acid, fumaric acid, phthalic acid, isophthalic acid, terephthalic acid, tetrachlorophthalic acid, and chlorendic acid; the acid anhydrides and acid halides of these acids may also be used.

The curatives, i.e., curing or cross-linking agents, which can be used with these polyurethane prepolymers are well known to those skilled in the art and typically contain active hydrogen atoms that are reactive with isocyanate groups. Exemplary of such curing agents are organic diamines (e.g., aromatic amines such as p,p'-diaminodiphenylmethane, p-phenylene diamine, aliphatic amines such as hexamethylenediamine, tetramethyldiamine, aminophenols (p-aminophenol, m-aminophenol), aminoalcohols (ethanolamine, p-aminobenzyl alcohol), diols or triols (e.g., 1,4-butanediol, trimethylolpropane) and, in some cases, additional diisocyanate can be used. Various catalytic or promoting substances, such as adipic acid, tin complexes (e.g., dibutyl tin dilaurate), or tertiary amines can also be used to aid curing. In addition, chain extenders to extend the length of the polymer chain can be included. Suitable chain extenders include the low molecular weight polyols, especially diols or triols, exemplified by 1,4-butanediol, hydroquinone bis(2-hydroxyethyl)ether, ethylene glycol, diethylene glycol, triethylene glycol, propylene glycol, dipropylene glycol, hexylene glycol, 2-methyl-2-ethyl-1,3-propanediol, 2-ethyl-1,3-hexanediol, 1,5-pentanediol, thiodiglycol, 1,3-propanediol, 1,3butanediol, 2,3-butanediol, neopentyl glycol, 1,2-dimethyl-1,2-cyclopentanediol, 1,2-cyclohexanediol, 1,2-dimethyl-1,2-cyclohexanediol, glycerol, trimethylol propane, trimethylol ethane, 1,2,4-butanetriol, 1,2,6-hexanetriol, pentaerythritol, dipentaerythritol, tripentaerythritol, mannitol, sorbitol, methylglucoside, and the like, as well as those typically used in one-shot systems such as are disclosed in U.S. Pat. Nos. 3,233,025; 3,620,905; and 3,718,622.

Thermoplastic polyurethane polymer systems can also be utilized. Generally, these systems employ the same types of polyurethane prepolymers, curatives, extenders and other components as described above. Typical thermoplastic polyurethane polymer systems are disclosed in *Polyurethane Technology*, Bruins, Interscience Publishers, pp. 198–200; *Modern Plastics Encyclopedia*, p. 289 (1968); *Rubber Chemistry and Technol-*

*ogy*, Vol. 35, P. 742, Schollenberger et al. (1962); U.S. Pat. Nos. 3,462,326 and 3,678,129, and are also commercially available under the trademarks Estane, Texir 480-A and Roylar E-9.

As mentioned earlier, other systems can also be used (e.g., polymers, resins, liquid rubbers, and the like) and, where appropriate, these systems can also include curing or cross-linking agents.

Regardless of the type of adhesive or bonding agent employed, it is critical that it be one which does not include water or does not react in such a way as to produce water, because water reacts readily with calcium carbide.

The amount of bonding agent employed will be somewhat dependent on such factors as the granule size of the calcium carbide, the strength of the bonded granular calcium carbide article desired for handling, the rate of dispersion desired when the bonded calcium carbide is immersed in molten metals and the type of bonding agent used. Generally, when the bonding agent is the preferred polyurethane polymer described above, the amount found satisfactory for use with calcium carbide granules having a size commonly known as Miner's lamp or smaller is about 5 to 100 parts per 100 parts of granular calcium carbide, preferably about 5 to 50 parts per 100 parts of granular calcium carbide, and most preferably about 10 to 25 parts per 100 parts of granular calcium carbide. Thus, it has been found that granular calcium carbide can be bonded into shaped articles, for example a block form, suitable for immersion in the molten metal, allowing the calcium carbide to be gradually released upon deterioration of the bonding agent, resulting in a more efficient reduction of the sulfur content in the metal. Presumably, the increased efficiency is due to a more thorough distribution of calcium carbide particles in the molten metal.

To obtain the bonded, granular calcium carbide articles of the invention, the granules of calcium carbide are thoroughly mixed with the bonding agent until an intimate admixture is obtained. Mixing can be accomplished by any suitable mechanical means such as a Hobart mixer, a screw conveyor, or an internal mixer such as a Banbury type mixer, and should preferably be such that the calcium carbide granules are thoroughly wetted by the bonding agent. Since moisture is detrimental to calcium carbide, the mixing should take place in a moisture-free or low-moisture atmosphere.

After mixing, the mixture is transferred to a suitable mold and the bonding agent is permitted to cure or become solidified depending upon the type of bonding agent used. When the bonding agent is the preferred polyurethane-based type, curing can be permitted to occur at ambient temperature or the mold can be placed in an oven maintained at a temperature up to about 93° C. to reduce curing time. Upon solidification or curing of the bonding agent, there is obtained a solid, integral mass of bonded calcium carbide granules having the size and shape of the mold into which it was placed.

The bonded calcium carbide article can then be removed from the mold for use. If the bonded calcium carbide article is not to be used for several hours, it should be protected from attack by atmospheric moisture on the surface of the shaped article. While the effect of atmospheric moisture is slow, it could become significant over prolonged periods of time. Thus, the bonded calcium carbide article can be readily protected from atmospheric moisture by wrapping it in a suitable moisture-impervious plastic film such as a film of polystyrene, polyethylene, polypropylene, and the like. Alternatively, the bonded articles can be protected by spraying their surfaces with or dipping them into a solution of, for example, a suitable plastic. Such a wrapping may be inserted into the mold as a lining prior to forming the bonded article. The wrapping serves the dual purpose of a release agent and moisture-protective coating after removal of the wrapping-covered article from the mold.

The molds used can be made from any serviceable material such as wood, metal, ceramic, plastic (e.g., poly(vinyl chloride), polystyrene, polyethylene, polypropylene), and the like. The molds used in a preferred embodiment are made from metals or plastic. The bonded calcium carbide article is left in the mold after solidification or curing of the bonding agent, and the mold serves a two-fold purpose in that it protects the bonded article from atmospheric moisture and provides a ready container for handling and shipping. Furthermore, the bonded article need not be removed from the mold when it is ready for use as the mold will melt upon being immersed in molten metal to thereby expose the bonded calcium carbide article.

While any size or shaped mold can be used to solidify or cure the calcium carbide granules into a solid, integral mass, the shaped article preferably should be of such a configuration that it enhances agitation of the molten metal upon rotation of said article while it is immersed in the molten metal mass. Hence, the shaped article should preferably have a non-circular cross-section perpendicular to the rotational axis, such as a square, rectangle, dumbbell, star, polygon, and the like. The rotation of the shaped article is usually achieved by attaching the shaped article to suitable rotation means, for instance a graphite or ceramic shaft which also serves as a device for immersing and maintaining said shaped article in the molten metal.

In the practice of this invention, other materials used for purification and alloying can be incorporated in the bonded calcium carbide article, such as limestone and magnesium. For example, magnesium is a metal typically used during steel-making but is difficult to disperse in the molten mass due to its relatively low density. However, when magnesium, or any other desired metal, is provided in powdered or granular form, it can be readily admixed with the calcium carbide granules and this admixture can then be further mixed with the bonding agent and the entire mixture solidified or cured as described above. In this way, such materials can be readily and easily added to the molten metal mass.

Upon being immersed into a molten metal mass, the bonded calcium carbide articles erode gradually from their surfaces inwardly toward their centers, thereby relatively slowly releasing the calcium carbide granules into the molten mass, thus enabling these granules to effectively and efficiently scavenge the sulfur in the molten metal. When an alloying metal is included in the bonded article as described above, it too will be similarly released into the molten metal.

Effective scavenging of sulfur from molten metals occurs when the sulfur content has been reduced to an acceptable level. In the case of steel, for example, an acceptable sulfur content level is about 0.001% to 0.030%. Normally, molten steel has a sulfur content of about 0.040% to 0.060% so that to effectively scavenge the sulfur content in molten steel means that this content must be reduced by from 25% to more than 95%. For specialty steels a sulfur content of less than 0.008% is highly preferred.

The following examples are set forth to further illustrate the invention and are not intended to be, nor should they be construed as being, limitative thereof. In the following examples all the ingredients for preparing the bonding agents used are commercially available with the exception of the liquid ethylene-propylene rubber.

EXAMPLE I — PREPARATION OF POLYURETHANE PREPOLYMER

A polyurethane prepolymer was prepared by mixing in a 55 gal. steel drum 37 parts by weight of tolylene diisocyanate (80/20 mixture of 2,4 and 2,6-isomers) and 100 parts of propoxylated glycerol (molecular weight ca. 3000, functionality about 3). The reaction mixture was stirred for about 4 hours with an air motor driven propeller (diameter about 7 inches), during which time the temperature of the mixture rose gradually to about 60° C. maximum. Subsequently the prepolymer (about 400 lbs. total) was blanketed with dry nitrogen and left standing at room temperature for 24 hours to ensure complete reaction. The resultant prepolymer contained 10% by weight of free NCO groups.

EXAMPLE II — PREPARATION OF BONDED CALCIUM CARBIDE

This example describes the preparation of a self-sustaining article comprising calcium carbide granules and a polyurethane bonding agent using the following recipe, containing 25.6% $CaC_2$ by weight:

| Ingredient | Amount (g) |
|---|---|
| Calcium carbide[1] | 1500. |
| Prepolymer of Example I | 450. |
| Crosslinking agent[2] | 67.5 |
| Catalyst[3] | 4.5 |
| Methylene chloride[4] | 45. |

[1]Mesh size = 6; product of Union Carbide Corp.
[2]Alkoxylated diethylenetriamine, OH No. = 475, molecular weight ca. 590, functionality ca. 5
[3]N,N',N'-trisdimethylaminopropyl-sym-hexahydrotriazine
[4]Processing aid Using the ingredients above, the calcium carbide granules were first charged to a one gallon Hobart mixer which was placed on low speed; that is, about 50–100 rpms. The remaining ingredients were then slowly added to the mixer in the order that they are listed above over a period of 1½ minutes. The mix was then agitated for another 4 minutes whereupon the mix was transferred with tamping to two pipe molds. The pipe molds comprised poly(vinyl chloride) pipes each having a diameter of 3 inches and a length of 24 inches. The mix was cured for 2 hours in the pipe molds in a hot air oven maintained at a temperature of 65° C. whereupon the solid, bonded granular calcium carbide articles obtained were removed from the pipe molds. One bonded article was wrapped in a sheet of polyethylene plastic film to prevent surface attack on the articles by atmospheric moisture while the other was left exposed to the atmosphere overnight. (The above mentioned unprotected and exposed bonded article evidenced substantial surface deterioration, presumably caused by attack from atmospheric moisture. This article was not submitted for evaluation in molten steel.)

Immediately prior to use, the polyethylene film was removed and the shaped article was immersed in molten steel which was at a temperature of about 1370° C. The bonded calcium carbide article gradually eroded, essentially retaining its shape and strength throughout erosion. Complete erosion of the bonding agent and concurrent releasing of the granules occurred over a period in excess of 3 minutes. The sulfur content of the molten steel was significantly reduced.

EXAMPLE III

Eight bonded calcium carbide blocks, each weighing about 100 pounds, were obtained following essentially the same procedure as Example II above, except that 2 Hobart mixer batches were used for preparing each block. Each batch was obtained according to the following formulation:

| Ingredient | Amount (g) |
|---|---|
| Calcium carbide of Ex. II | 18,500. |
| Prepolymer of Ex. I | 3,350. |
| Crosslinking agent of Ex. II | 500. |
| Catalyst of Ex. II | 25. |
| Methylene chloride | 335. |
| | 22,710 |
| (% bonding agent: 19% by wt.) | |

A suitable mold was filled with two batches and cured at room temperature for about 1 hour resulting in a block having the shape indicated on FIG. I. Upon curing, the shaped articles were removed from the mold and wrapped in polyethylene film.

The eight interlocking blocks were slipped in sequence on a graphite shaft and secured in place by suitable holding means (see FIG. II). Subsequently, the mounted blocks were immersed in molten steel while rotating the shaft-block assembly at about 60 rpm.

Upon touching the surface of and submerging in 200 tons of molten steel kept in a crucible, considerable evolution of sparks was observed which subsided after about 15 minutes of immersion of the blocks, indicating complete disintegration of said blocks and release of the calcium carbide into the molten steel.

Analysis indicated that the sulfur content of the steel (originally 0.042%) was effectively reduced to about 0.030%. This 29% reduction is normally achieved with at least twice (ca. 2200 lbs.) the amount of calcium carbide employing prior art methods.

EXAMPLE IV

The ingredients listed in the recipes below were charged to a paper cup containing the specified amount of calcium carbide. The materials were thoroughly agitated until an essentially uniform mixture was obtained. Where highly volatile solvents were used the bulk of these solvents was removed by simple evaporation under atmospheric pressure and at room temperature. Any traces of residual solvents were subsequently driven off by placing the samples in a vacuum oven at about 100° C. and 5 mm Hg overnight.

In some instances portions of the calcium carbide-polymer blend were transferred to molds for the purpose of obtaining dumbbell shaped samples for tensile testing and/or rectangular samples for the impact testing.

SAMPLE NO. 1

The following materials were blended in a 16 oz. cup.

| Ingredient | Amount (g) |
|---|---|
| Calcium carbide of Ex. II | 625. |
| Prepolymer of Ex. I | 112. |
| Crosslinking agent of Ex. I (67.5 parts) Catalyst of Ex. I (4.5 parts) Methylene chloride (45 parts) | 29.3* |

*Curative mixture, premixed

After mixing thoroughly, the polymer was essentially fully cured after standing for 2 hours at room temperature. The resultant bonded calcium carbide was then tested for physical properties with results indicated on Table I.

SAMPLE NO. 2

This sample contained the same ingredients and was prepared in the same way as Sample 1 above except that the amounts were reduced as shown below.

| Ingredient | Amount (g) |
|---|---|
| Granular calcium carbide | 100.0 |
| Prepolymer | 19.9 |
| Curative mixture of Sample 1 | 5.1 |

SAMPLE NO. 3

In this sample, a one-shot polyurethane system was used as the bonding agent. The one-shot polyurethane system was obtained in the presence of the calcium carbide granules from the reaction of toluene diisocyanate (TDI), polytetramethylene ether glycol (PTMG, molecular weight 1000), 1,4-butanediol and a catalyst.

| Ingredient | Amount (g) |
|---|---|
| Calcium carbide of Ex. II | 100.0 |
| PTMG | 15.8 |
| 1,4-Butanediol | 1.4 |
| TDI of Ex. I | 7.8 |
| Catalyst (dibutyl tin dilaurate) | 0.05 |

The granular calcium carbide was first blended with the polyols and the catalyst. Subsequently the TDI was added with further mixing and the total reaction mixture was cured for 2 hours at room temperature. Physical properties of the polyurethane bonded calcium carbide are listed in Table I.

SAMPLE NO. 4

An epoxy prepolymer (reaction product of epichlorohydrin and bisphenol A) having a molecular weight of 380 and a viscosity of about 130 poise was used as the bonding agent. The epoxy prepolymer and a curing agent for the epoxy prepolymer, triethylenetetramine (TETA), were combined in an amount of 20.0 parts and 2.4 parts, respectively, to provide a bonding agent-curative mixture and then added to the calcium carbide granules in a paper cup while stirring.

| Ingredient | Amount (g) |
|---|---|
| Calcium carbide of Ex. II | 38.0 |
| Bonding agent-curative mixture | 7.2 |

The $CaC_2$-bonding agent mixture was cured for about 7 hours at room temperature. Physical properties were determined as presented in Table I.

SAMPLE NO. 5

A phenolic resin in powdered form was used as the bonding agent for this sample. The phenolic resin was of the novolac type (condensation product of formaldehyde with excess phenol) having a molecular weight of about 1300 and containing an effective amount of a curative, hexamethylenetetramine (HEXA). During mixing, lime, although not essential, was added to enhance the rate of cure.

| Ingredient | Amount (g) |
|---|---|
| Granular calcium carbide of Ex. II | 76.8 |
| Phenolic resin plus HEXA | 13.0 |
| Furfural (solvent) | 3.2 |
| Lime | 1.3 |

The granular calcium carbide was first wetted with the furfural and the resin plus curative mixture was then added. Mixing of all ingredients was continued until a uniform mixture was obtained. The mixture was transferred to a mold for impact test samples with tamping wherein it was cured for 18 hours at 60° C. For physical properties, see Table I.

SAMPLE NO. 6

The bonding agent used in this sample was a liquid styrene-butadiene rubber (SBR) having a 75/25 butadiene/styrene weight ratio, a viscosity of 225 poise (30° C.) and an hydroxyl No. of 0.65. The curative (Br-resin) for the SBR was of the phenolic type having a molecular weight of about 500 and containing about 29% bromine, known as CRJ-328, product of Schenectady Chemical Company. A polymer-curative mixture was prepared comprising liquid SBR (67 parts), Br-resin (20 parts) and zinc oxide (13 parts).

| Ingredient | Amount (g) |
|---|---|
| Granular calcium carbide | 100.0 |
| Polymer-curative mixture | 25.0 |

Mixing of the ingredients was then accomplished.

SAMPLE NO. 7

For this sample, a liquid ethylene-propylene-nonconjugated diene terpolymer (EPDM) (ethylene = 59%, propylene = 35%, 5-ethylidene-2-norbornene = 6% by weight) having a viscosity of about 1500 poise was used as the bonding agent. Such a terpolymer can be readily prepared in accordance with the procedures set forth in U.S. Pat. No. 3,819,592 (June 25, 1974), which patent is hereby incorporated herein by reference; see especially Example 31. A bonding agent-curative mixture was prepared comprising the liquid EPDM (16.75 parts), the Br-resin (5 parts) and zinc oxide (3.25 parts) as in Sample 6 above.

| Ingredient | Amount (g) |
|---|---|
| Granular calcium carbide | 100.0 |
| Bonding agent-curative mixture | 25.0 |

Mixing of the ingredients was then accomplished.

SAMPLE NO. 8

A 20% solution of a polyurethane cement was used as the bonding agent in this sample. The urethane polymer, containing free (0.5% by weight) NCO groups, was prepared from methylenebis(4-phenyl isocyanate) (131 parts), PTMG (247 parts), 1,4-butanediol (22 parts), a mixture of primary alcohols having an average molecular weight of 207 (2.1 parts) and dibutyltin dilaurate (catalyst, 0.4 part). The polYurethane polymer (50 parts) was dissolved in a 70/30 weight mixture of tetrahydrofurane/cyclohexanone (200 parts) to provide the bonding agent cement. To 100 g. of calcium carbide granules (mesh size = 6) in a 4 oz. cup was added 62.5 g. of the cement while agitating the mixture vigorously. The solvent was then removed. Physical properties obtained from the bonded calcium carbide article are summarized in Table I.

SAMPLE NO. 9

The same ingredients and preparation were used to make this sample as Sample 8 above except that the amount of urethane cement mixture was reduced to 25 g.

SAMPLE NO. 10

In this sample, a cement comprising a 30% acetone solution of a styrene (75%)-acrylonitrile (25%) copolymer (SAN) having an intrinsic viscosity (I.V.) of about 0.85 (in methylethyl ketone at 30° C.) was used as the bonding agent.

| Ingredient | Amount (g) |
|---|---|
| Granular calcium carbide | 100.0 |
| SAN resin cement | 27.0 |

The ingredients were then mixed together.

Physical testing of Samples 1 through 10 was undertaken in order to determine their resistance to physical stress encountered during their transfer from the place of manufacture to the location of actual use (e.g., a steel mill). Samples 1 and 2 are substantially based on the same polyurethane system as Examples II and III and have the same physical characteristics of these articles which were used successfully in the reduction of sulfur content in molten steel. Samples 3 through 10 exhibit essentially similar tensile and impact strength as Samples 1 and 2. In addition to the tests listed in Table I each sample article was dropped onto a concrete floor from a height of about 4 and ½ feet to establish their resistance to physical abuse. In all cases the bonded calcium carbide articles retained original shape, without shattering or other damage to the structural integrity such as loss of particles.

The ultimate tensile strength results were obtained by using standard 8 in. dumbbell shaped testing samples in an Instron testing machine at a pull rate of 0.2 inch/-min. Impact measurements were undertaken using the ASTM D250-72a method but without having notched the samples. The cohesion of the blocks was judged as GOOD if no calcium carbide particles could be removed from a relatively smooth surface without effort, and FAIR if some particles could be dislocated by rubbing the surface.

TABLE I

Physical Characteristics of Bonded Granular Calcium Carbide Samples

| Sample No. | Bonding Agent | Form | Amount (pph $CaC_2$) | Cohesion | Tensile (psi) | Impact Strength (ft. lbs.) |
|---|---|---|---|---|---|---|
| 1 | Urethane | Prepolymer | 21 | Good | 121 | .42 |
| 2 | Urethane | Prepolymer | 23 | Good | 262 | 1.4 |
| 3 | Urethane | One-shot | 25 | Good | — | — |
| 4 | Epoxy | Prepolymer | 19 | Good | 610 | .57 |
| 5 | Phenolic resin | Prepolymer | 17 | Good | — | — |
| 6 | Liquid SBR | Liquid polymer | 22 | Good | 75 | .96 |
| 7 | Liquid EPDM | Liquid polymer | 22 | Good | 45 | 1.23 |
| 8 | Urethane | Cement | 13 | Good | — | .85 |
| 9 | Urethane | Cement | 5 | Good | — | .85 |
| 10 | SAN resin | Cement | 8 | Fair | — | .34 |

As can be seen from the results set forth in Table I above, the bonded calcium carbide articles of the invention exhibit sufficient physical properties with each type of bonding agent used so that they can be readily and easily handled and used for the reduction of sulfur in molten metal.

Various methods and means can be used to introduce the bonded calcium carbide articles into a molten metal mass, for example, a graphite or ceramic plunger pushing the bonded calcium carbide article below the surface of the molten metal, preferably while providing appropriate agitation of the molten metal by the use of, for instance, suitable paddles.

Another method of introducing bonded calcium carbide articles of the invention into molten metals is to use the graphite rods or shafts. For example, this can be accomplished by bonding the calcium carbide granules into rectangular blocks using molds that form a peripheral lip at one end of each block and an indented, protruding extension at the other end of each block. Each block can then have a hole bored longitudinally through its center so that the blocks can be threaded onto the graphite shafts and stacked thereon in interlocking relationship with the protruding extension at one end of a block fitted into the peripheral lip at the end of an adjacent block. Thus, the graphite shaft serves as an axle for the blocks and, upon immersing the shaft into a molten metal mass, the shaft can be rotated to agitate and stir the molten mass. Since the blocks are placed in interlocking relationship on the shaft, they also rotate with the shaft.

If desired, the method for reducing the sulfur level in the molten metal may be repeated several times for further reduction, or other means such as the use of an air or oxygen blast through the molten metal may be employed.

It will be appreciated by those skilled in the art that the type and size of molds employed, the method of mixing, and the type of bonding agents used can be varied and modified as desired to meet specific conditions. Thus, while the invention has been described with particularity and in some detail, changes and modifications can be made therein without departing from the scope and spirit of the invention.

What is claimed is:

1. A non-circular, self-sustaining shaped article, useful for reducing the sulfur content of molten steel, comprising granular calcium carbide bonded with a crosslinked polymeric bonding agent selected from the group consisting of polyurethane, polyesters, phenolic resins, epoxy resins, liquid styrene-butadiene copolymers, polybutadiene, isobutylenediene copolymers, polysulfide polymers and ethylene-propylene-non-conjugated diene terpolymers.

2. In an improved method for reducing the sulfur content of molten steel by using calcium carbide, the improvement comprising introducing the calcium carbide in the form of a non-circular, self-sustaining shaped article, said shaped article comprising granular calcium carbide bonded with a crosslinked polymeric bonding agent selected from the group consisting of polyurethane, polyesters, phenolic resins, epoxy resins, liquid styrene-butadiene copolymers, polybutadiene, isobutylenediene copolymers, polysulfide polymers and ethylene-propylene-non-conjugated diene terpolymers.

3. A method for reducing the sulfur content of molten steel comprising the steps:

a. providing a non-circular, self-sustaining shaped article comprising granular calcium carbide and a crosslinked polymeric bonding agent selected from the group consisting of polyurethane, polyesters, phenolic resins, epoxy resins, liquid styrene-butadiene copolymers, polybutadiene, isobutylene-diene copolymers, polysulfide polymers and ethylene-propylene-non-conjugated diene terpolymers;

b. attaching said shaped article to submerging and rotating means; and c. submerging and rotating said shaped article in molten steel thereby agitating the molten steel and causing said shaped article to erode at a controlled rate and releasing said calcium carbide into the molten steel.

4. The method of claim 3, wherein said submerging and rotating means is a shaft prepared from materials selected from graphite and ceramic.

5. The method of claim 2, wherein said shaped article has a non-circular cross-sectional configuration selected from square, rectangle, dumbbell, star and polygon.

6. The article of claim 1, wherein said bonding agent is present at a concentration of 5 to 100 parts per 100 parts of calcium carbide, all by weight.

7. The article of claim 1, wherein the polymeric bonding agent is crosslinked polyurethane.

8. The article of claim 7, wherein the crosslinked polyurethane is based on a polyurethane prepolymer.

9. The article of claim 8, wherein said crosslinked polyurethane is prepared from a polyurethane prepolymer having up to ten percent by weight of non-reacted isocyanate groups, and a crosslinking agent.

10. The article of claim 9, wherein said crosslinked polyurethane is prepared from a polyurethane prepolymer, a crosslinking agent and a catalyst.

11. The article of claim 1, wherein the bonding agent is present at a concentration of from 5 to 50 parts per 100 parts of calcium carbide.

12. The article of claim 1, wherein the bonding agent is present at a concentration of from 10 to 25 parts per 100 parts of calcium carbide.

13. The article of claim 1, wherein said granular calcium carbide has a mesh size of Miner's lamp or less.

14. The article of claim 1, wherein said granular calcium carbide has a mesh size of 6.

15. The article of claim 8, wherein said polyurethane polymer is a reaction product of a polyisocyanate, a polyalkylene ether polyol, a crosslinking agent and a catalyst, said reaction product being present at a concentration of from 5 to 50 parts per 100 parts of granular calcium carbide having a mesh size of 6.

16. The article of claim 8, wherein said polyurethane polymer is the reaction product of a polyisocyanate, a polyester polyol, a crosslinking agent and a catalyst.

17. The article of claim 1, wherein said article is enveloped by a water impermeable cover.

18. The article of claim 17, wherein said cover comprises the mold in which the article was formed.

19. The method of claim 2, wherein said bonding agent is a crosslinked polymer selected from the group consisting of polyurethane, polyesters, phenolic resins, epoxy resins, liquid styrene-butadiene copolymers, polybutadiene, ethylene-propylene-non-conjugated diene terpolymers, isobutylene-diene copolymers and polysulfide polymers, and is present at a concentration of from 5 to 100 parts by weight per 100 parts of calcium carbide.

20. The method of claim 19, wherein said polyurethane is the reaction product of a polyurethane prepolymer containing up to 10 percent by weight unreacted isocyanate groups and a crosslinking agent.

21. The method of claim 20, wherein said reaction product also includes a catalyst.

22. The method of claim 3, wherein said bonding agent is the reaction product of a polyurethane prepolymer, a crosslinking agent and a catalyst, and is present at a concentration of from 10 to 25 parts by weight per 100 parts of calcium carbide.

* * * * *